US008033837B2

(12) United States Patent
Yang et al.

(10) Patent No.: US 8,033,837 B2
(45) Date of Patent: Oct. 11, 2011

(54) ELECTRICAL CONNECTOR WITH AN IMPROVED SPACER

(75) Inventors: Bo Yang, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/908,001

(22) Filed: Oct. 20, 2010

(65) Prior Publication Data

US 2011/0092098 A1 Apr. 21, 2011

(30) Foreign Application Priority Data

Oct. 20, 2009 (CN) ..... 2009 2 0312783

(51) Int. Cl.
*H01R 12/00* (2006.01)

(52) U.S. Cl. ..... 439/79; 439/607.4

(58) Field of Classification Search ..... 439/55, 439/79, 80, 607.4
See application file for complete search history.

(56) References Cited

U.S. PATENT DOCUMENTS

| | | | | |
|---|---|---|---|---|
| 6,142,833 | A * | 11/2000 | Zhu et al. | 439/638 |
| 6,554,642 | B1 * | 4/2003 | Xiang et al. | 439/567 |
| 6,685,486 | B1 * | 2/2004 | Zhang et al. | 439/79 |
| 6,736,676 | B2 * | 5/2004 | Zhang et al. | 439/607.22 |
| 6,821,161 | B1 * | 11/2004 | Cao | 439/701 |
| 7,517,233 | B2 | 4/2009 | Xiang | |
| 7,789,702 | B1 * | 9/2010 | Xiang et al. | 439/567 |
| 2009/0149060 | A1 * | 6/2009 | Zhu et al. | 439/485 |

* cited by examiner

*Primary Examiner* — Renee S Luebke
*Assistant Examiner* — Larisa Tsukerman
(74) *Attorney, Agent, or Firm* — Wei Te Chung; Andrew C. Cheng; Ming Chieh Chang

(57) ABSTRACT

An electrical connector (100) includes an insulative housing (1) having a base portion (11), and a pair of extending portions (114) extending backwardly from the base portion and spaced apart from each other along a transverse direction to form a receiving space (1143) therebetween, each extending portion defining a first slot (1142) communicating with the receiving space and a first block (1144) located at an inner side of the first slot; a plurality of electrical contacts (2) retained in the insulative housing and passing through the receiving space; and a spacer (6) attached to the insulative housing for retaining the electrical contacts, the spacer having a pair of second slots (65) for receiving the first blocks and a pair of second blocks (66) located at outer sides of the corresponding second slots (65) for being retained in the first slots (1142).

16 Claims, 5 Drawing Sheets

ELECTRICAL CONNECTOR WITH AN IMPROVED SPACER

BACKGROUND OF THE INVENTION

1. Field of the Invention

The present invention relates to an electrical connector, and more particularly to an electrical connector having an improved spacer for retaining electrical contacts.

2. Description of Related Art

Electrical connectors present as a medium being widely used in computers and other electronic devices for electrically connecting the electronic device with each other to transmit signals. A common electrical connector usually includes an insulative housing, a plurality of contacts retained in the insulative housing for transmitting signals, a metal shell covering the insulative housing for shielding the electrical connector from being disturbed, a spacer coupled to the insulative housing for retaining the contacts. The insulative housing has a pair of extending portions with a receiving space formed therebetween for receiving the contacts and the spacer. When the spacer is assembled to the insulative housing, the spacer has a pair of projections latched with the extending portions or received in a pair of slots formed in the extending portions so as to be retained in the insulative housing.

However, when the spacer has been assembled to the extending portions, the spacer usually could not be retained in the insulative housing firmly and may have a loose fit with the insulative housing or even drop out from the insulative housing.

Hence, an improved electrical connector with an improved grounding means is desired to overcome the above problems.

BRIEF SUMMARY OF THE INVENTION

According to one aspect of the present invention, an electrical connector comprises: an insulative housing having a base portion, and a pair of extending portions extending backwardly from the base portion and spaced apart from each other along a transverse direction to form a receiving space therebetween, each extending portion defining a first slot communicating with the receiving space and a first block located at an inner side of the first slot; a plurality of electrical contacts retained in the insulative housing and passing through the receiving space; and a spacer attached to the insulative housing for retaining the electrical contacts, the spacer having a pair of second slots for receiving the first blocks and a pair of second blocks located at outer sides of the corresponding second slots for being retained in the first slots.

According to another aspect of the present invention, an electrical connector comprises: an insulative housing defining a base portion, a mating portion extending forwardly from the base portion, a pair of extending portions extending backwardly from the base portion and spaced apart from each other in a transverse direction, and a receiving space formed among the base portion and the extending portions, the extending portions having a pair of first U-shaped locking portions facing upwardly and located at two lateral sides of the receiving space; a plurality of electrical contacts retained in the insulative housing and defining contacting portions retained in the mating portion, tail portions mounted onto a printed circuit board and located between the extending portions, and connecting portions connecting the contacting portions and the tail portions; a spacer coupled to the insulative housing and defining a plurality of retaining holes for the tail portions passing through, the spacer having a pair of second U-shaped locking portions facing downwardly and located at two lateral sides thereof for latching with the first U-shaped locking portions so that the spacer could be retained in the insulative housing firmly in the transverse direction; and a metal shell coupled to the insulative housing for shielding the contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
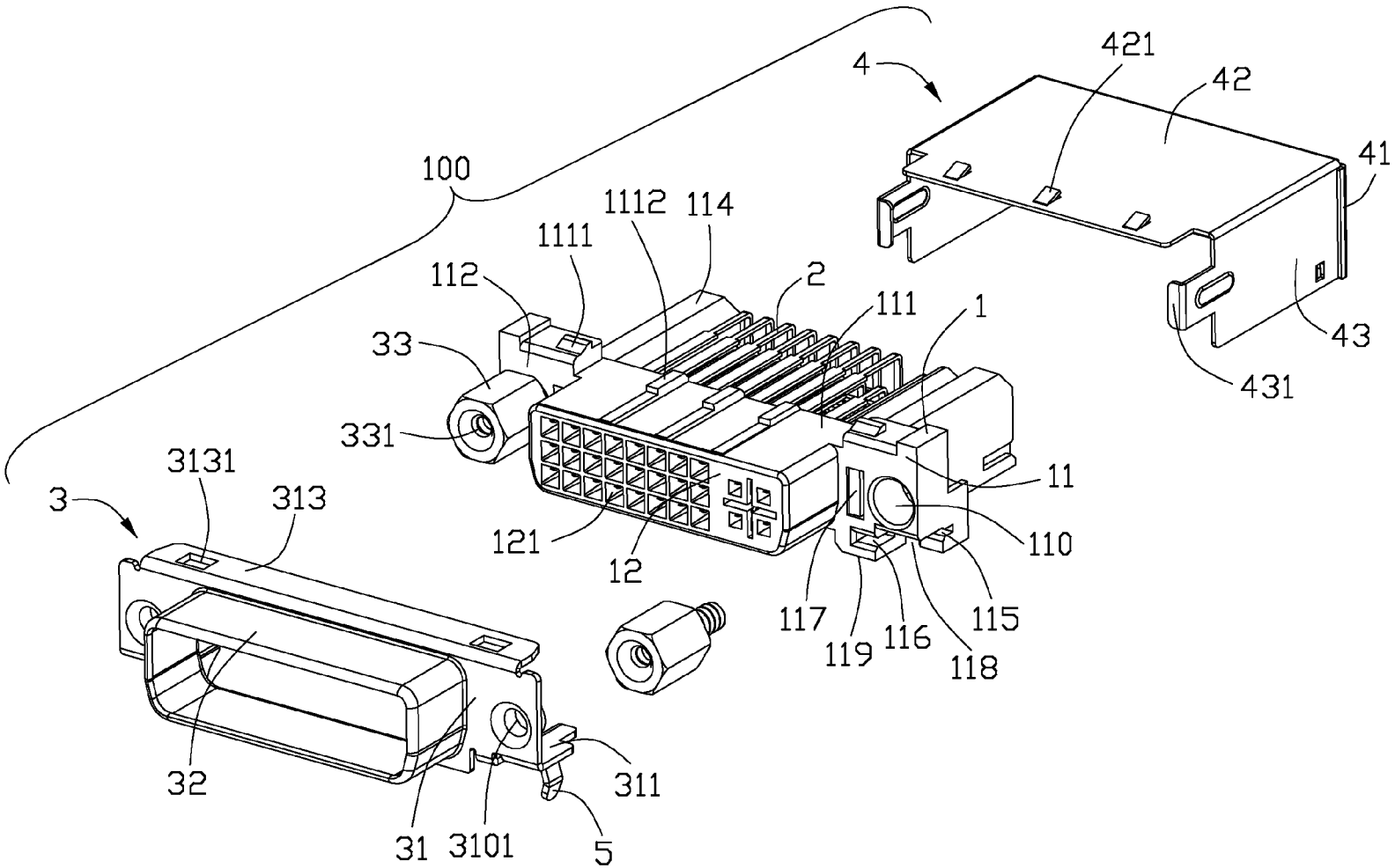
FIG. 1 is a partly exploded view of an electrical connector according to the present invention.
Figure 2:
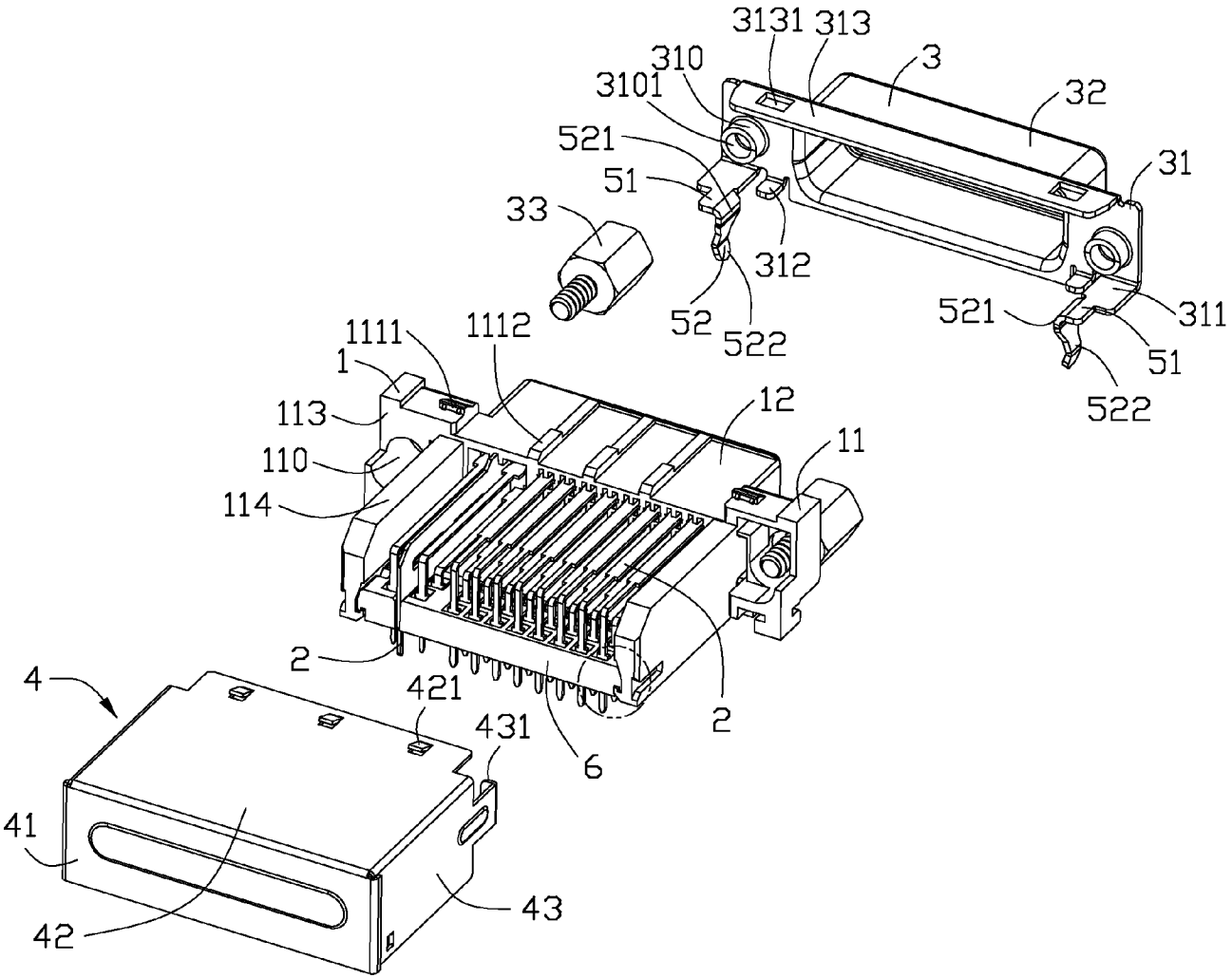
FIG. 2 is a view similar to FIG. 1, while taken from another aspect.
Figure 3:
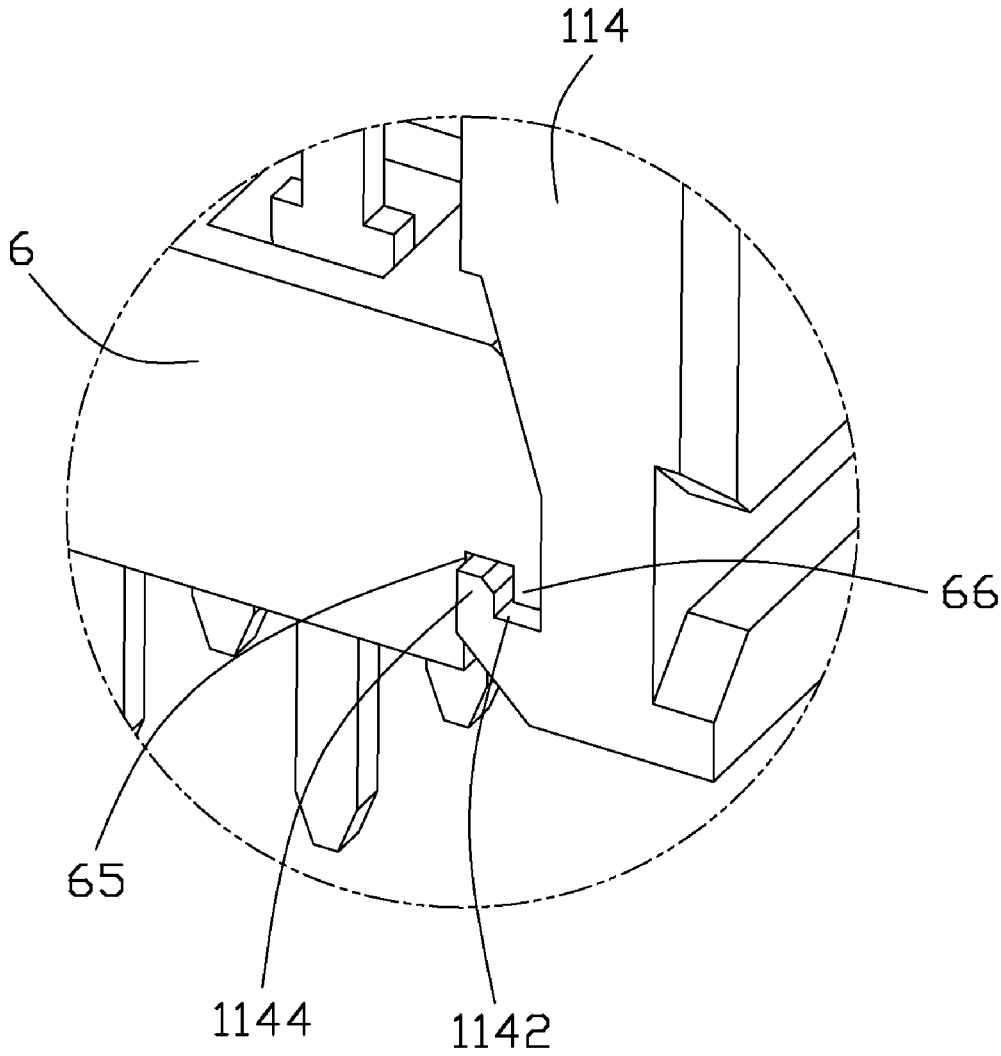
FIG. 3 is an enlarged view of a circle portion shown in FIG. 2.
Figure 4:
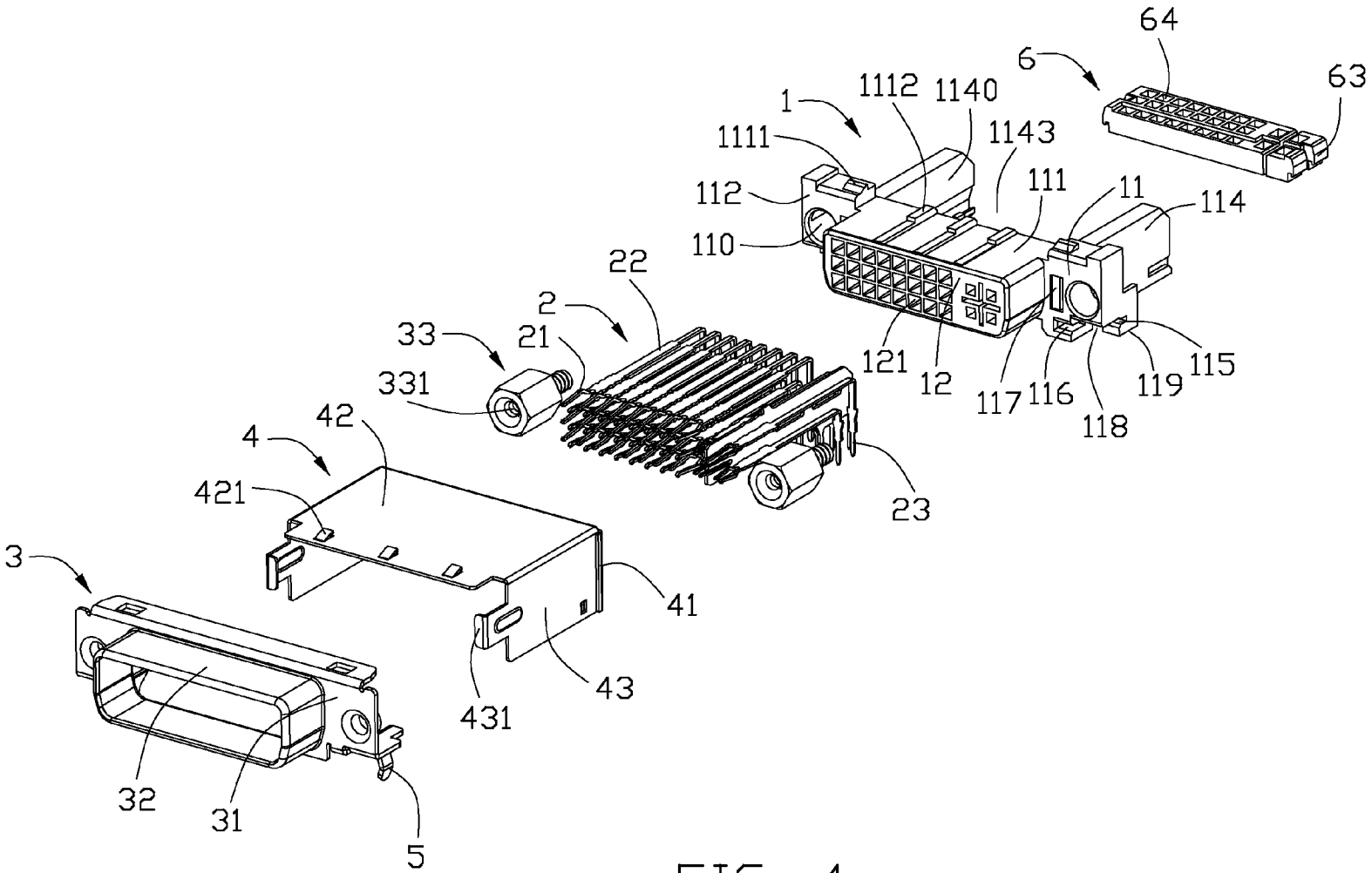
FIG. 4 is an exploded view of the electrical connector shown in FIG. 1.
Figure 5:
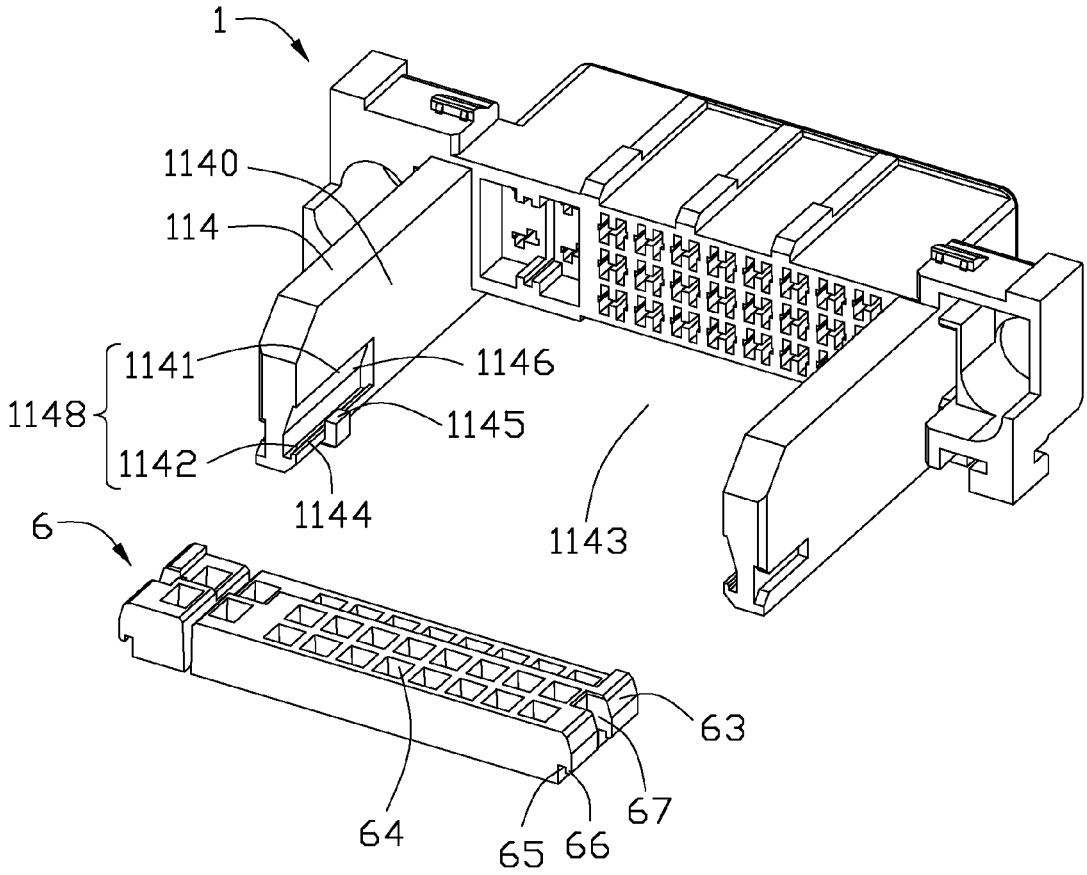
FIG. 5 is a perspective view showing an insulative housing and a spacer of the electrical connector shown in FIG. 1.

Referring to FIGS. 1-5, an electrical connector 100 according to the present invention for being mounted onto a printed circuit board (PCB, not shown) is disclosed. The electrical connector 100 includes an insulative housing 1, a set of electrical contacts 2 retained in the insulative housing 1, a metal shell 3 for covering a front portion of the insulative housing 1, a metal cover 4 for covering a rear portion of the insulative housing 1 and contacting with the metal shell 3, and a spacer 6 coupled to the insulative housing 1 for retaining the electrical contacts 2.

Referring to FIGS. 1-5, the insulative housing 1 is molded of dielectric material such as plastic or the like, and includes a base portion 11, a mating portion 12 extending forwardly from a front face 112 of the base portion 11 and defining a set of passageways 121 passing therethrough along a front-to-rear direction, and a pair of extending portions 114 extending backwardly from a back face 113 of the base portion 11 and spaced apart from each other along a transverse direction perpendicular to the front-to-rear direction. A receiving space 1143 is formed among the base portion 11 and the extending portions 114 and communicates with the passageways 121 in the front-to-rear direction. Each extending portion 114 defines an inner face 1140 facing the receiving space 1143, a slot 1148 recessed outwardly from the inner face 1140, and an embossment 1145 protruding inwardly and upwardly from the inner face 1140 and located at an inner side of the slot 1148. The slot 1148 includes an oblique slot 1141 defining an oblique face 1146 extending in an oblique direction relative to the inner face 1140, and a first slot 1142 located under the oblique slot 1141 and communicating with the oblique slot 1141. The first slot 1142 is formed by a first U-shaped locking portion facing upwardly. The base portion 11 has a pair of projections 1111 projecting upwardly from an upper surface 111 thereof for latching with the metal shell 3 and a set of ribs 1112 extending upwardly from the upper surface 111 for resisting the metal cover 4. The base portion 11 has a pair of through holes 110 passing therethrough along the front-to-rear direction and located at outsides of the extending portions 114, a pair of apertures 117 passing therethrough along the front-to-rear direction and each located between the corresponding extending portion 114 and through hole 110. The base portion 11 has a pair of retaining slots 115 and a pair of securing slots 116 recessed backwardly from a front face thereof and located below the through holes 111, a pair of notches 118 passing downwardly through a lower surface 119 thereof and each being located between the retaining slots 115 and the securing slot 116.

The electrical contacts 2 have contacting portions 21 extending into the passageways 121 for contacting with a complementary mating plug (not shown), tail portions 23 passing through retaining holes 64 formed on the spacer 6 for being mounted to the PCB, and connecting portions 22 connecting the contacting portions 21 and the tail portions 23 and being received in the receiving space 1143.

The metal shell 3 has a main portion 31 leaning against the front face 112 of the base portion 11 backwardly, and a sleeve portion 32 extending forwardly from the main portion 31 and encircling the mating portion 12 for shielding the contacting portions 21. The main portion 31 has a pair of columns 310 integrally stamped backwardly therefrom and protruding into the through hole 111, a pair of board locks 5 integrally extending from a lower end thereof for being mounted onto the PCB, and a pair of tabs 312 extending backwardly from the lower end and located between the board locks 5 for being retained in the securing slots 116 of the insulative housing 1. The electrical connector 100 further comprises a pair of nuts 33. Each column 310 defines a perforation 3101 passing therethrough for the nut 33 going through. The nuts 33 have threaded holes 331 passing therethrough along the front-to-rear direction for screws of the mating plug screwed into. In another embodiment, the nuts 33 could integrally extend forwardly from the main portion 31, and the threaded holes 331 communicates with the corresponding through holes 111 along the front-to-rear direction. The board lock 5 has a horizontal portion 311 extending horizontally from the lower end of the main portion 31, a retaining portion 51 extending backwardly from the horizontal portion 311 and being retained in the retaining slot 115 of the insulative housing 1, and a leg 52 extending downwardly from a lateral side of the retaining portion 51 and passing through the corresponding notch 118 for being mounted onto the PCB. The leg 52 includes a first arc portion 521 extending downwardly from the retaining portion and bowed inwardly, and a second arc portion 522 extending downwardly from a lower end of the first arc portion 521 and bowed outwardly. An upper plate 313 extends horizontally and backwardly from an upper end of the main portion 31 and has a pair of cavities 3131 for latching with the projections 1111. Therefore, the metal shell 3 is retained on the insulative housing 1 firmly. The base portion 11 is sandwiched between the upper plate 313 and the horizontal portions 311 in an upper to lower direction. In this invention, the board locks 5 are integrally formed with the metal shell 3, the number of the elements of the electrical connector 100 is decreased, and the assembly process will be simplified.

The metal cover 4 includes a top wall 42, a rear wall 41 bending downwardly from a rear end of the top wall 42, and a pair of side walls 43 bending downwardly from two lateral sides of the top wall 42. The top wall 42 covers the upper surface 111 of the base portion 11 and is resisted upwardly by the ribs 1112. A set of protrusions 421 protrude upwardly from the top wall 42 and contact with the upper plate 313. Therefore, the cover 4 could electrically contact with the metal shell 3, and the static electricity on the cover 4 could be eliminated via the board locks 5 which are integrally formed with the metal shell 3. A pair of clasps 431 extend forwardly from the corresponding side walls 43 and pass through the corresponding apertures 117. The clasps 431 bend inwardly at front ends thereof and clasp on the front face of the base portion 11 to contact with the main portion 31 reliably.

The spacer 6 is assembled to the insulative housing 1 along a lower-to-upper direction. The spacer 6 has a pair of second U-shaped locking portion formed at two lateral sides thereof and facing downwardly for latching with the first U-shaped locking portion which faces upwardly so that the spacer 6 could be retained in the insulative housing 1 firmly along the transverse direction, a pair of recesses 67 recessed inwardly from outer faces of the second U-shaped locking portion for receiving the embossments 1145 of the insulative housing 1 so that the spacer 6 could be retained in the insulative housing 1 firmly along the front-to-rear direction, and a pair of inclined face 63 formed on two lateral sides thereof and being located above the second U-shaped locking portions. The first U-shaped locking portion has a first block 1144 retained in a second slot 65 defined by the second U-shaped locking portion. The embossments 1145 locate at inner sides of the first blocks 1144. The second U-shaped locking portion has a second block 66 retained in the first slot 1142 defined by the first U-shaped locking portion. A first dimension measured between two outer faces of the second U-shaped locking portion is larger than a second dimension measured between two inner faces 1140 of the extending portions 114. When the spacer 6 is assembled to the insulative housing 1 from a lower face of the insulative housing 1, the extending portions 114 are flared outwardly to create an enlarged space for the spacer 6 assembled to a predetermined position of the insulative housing 1. When the spacer 6 has been assembled to the insulative housing 1, the extending portions 114 which have been flared outwardly could be kept on their original places via the second U-shaped locking portions latching with the first U-shaped locking portions respectively, the oblique faces 1146 resist the inclined faces 63 so as to prevent the spacer 6 from moving upwardly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing having a base portion, and a pair of extending portions extending backwardly from the base portion and spaced apart from each other along a transverse direction to form a receiving space therebetween, each extending portion defining a first slot communicating with the receiving space and a first block located at an inner side of the first slot;

a plurality of electrical contacts retained in the insulative housing and passing through the receiving space; and a spacer attached to the insulative housing for retaining the electrical contacts, the spacer having a pair of second slots for receiving the first blocks and a pair of second blocks located at outer sides of the corresponding second slots for being retained in the first slots; wherein each extending portion has an embossment protruding inwardly from an inner face thereof and located at an inner side of the first block, the spacer has a pair of recesses recessed inwardly from two lateral faces thereof for receiving the corresponding embossments.

2. The electrical connector according to claim 1, wherein each extending portion has an oblique slot defining an oblique face extending in an oblique direction, the oblique slot is located above the first slot and communicates with the first slot, the spacer has a pair of inclined faces formed at two lateral sides thereof and located above the corresponding second blocks for being resisted by the oblique faces.

3. The electrical connector according to claim 1, wherein the spacer defines a first dimension measured between two lateral faces thereof larger than a second dimension measured between two inner faces of the extending portions, when the spacer is assembled to the insulative housing, the extending portions are flared outwardly to create an enlarged space for the spacer assembled to the insulative housing.

4. The electrical connector according to claim 1, wherein the electrical connector comprises a metal shell coupled to the insulative housing, the metal shell has a main portion leaning against a front face of the base portion backwardly and a pair of board locks integrally extending from the main portion for being mounted onto a printed circuit board.

5. The electrical connector according to claim 4, wherein the board lock comprises a horizontal portion extending horizontally from a lower end of the main portion, a retaining portion extending backwardly from the horizontal portion and being retained in a retaining slot formed on the base portion, and a leg bending downwardly from a lateral side of the retaining portion for being mounted onto the printed circuit board.

6. The electrical connector according to claim 5, wherein the leg includes a first arc portion extending downwardly from the retaining portion and bowed outwardly, and a second arc portion extending downwardly from a lower end of the first arc portion and bowed inwardly.

7. The electrical connector according to claim 5, wherein the metal shell has an upper plate extending horizontally and backwardly from an upper end of the main portion, the upper plate has a pair of cavities for latching with projections formed on an upper surface of the base portion, the base portion is sandwiched between the upper plate and the horizontal portions in an upper-to-lower direction.

8. The electrical connector according to claim 7, wherein the electrical connector further comprises a metal cover having a top wall covering the upper surface of the base portion and a pair of side walls extending downwardly from two lateral sides of the top wall, the base portion has a set of ribs extending upwardly from the upper surface thereof for resisting the top wall upwardly.

9. The electrical connector according to claim 8, wherein the top wall is sandwiched between the upper plate and the upper surface of the base portion, the top wall has a set of protrusions protruding upwardly for contacting with the upper plate.

10. The electrical connector according to claim 8, wherein the base portion has a pair of apertures passing therethrough along a front-to-rear direction, the side walls have a pair of clasps extending forwardly from the corresponding side walls and passing through the corresponding apertures, the clasps bend inwardly at front ends thereof and clasp on the front face of the base portion to contact with the main portion.

11. An electrical connector, comprising:

an insulative housing defining a base portion, a mating portion extending forwardly from the base portion, a pair of extending portions extending backwardly from the base portion and spaced apart from each other in a transverse direction, and a receiving space formed among the base portion and the extending portions, the extending portions having a pair of first U-shaped locking portions facing upwardly and located at two lateral sides of the receiving space;

a plurality of electrical contacts retained in the insulative housing and defining contacting portions retained in the mating portion, tail portions mounted onto a printed circuit board and located between the extending portions, and connecting portions connecting the contacting portions and the tail portions;

a spacer coupled to the insulative housing and defining a plurality of retaining holes for the tail portions passing through, the spacer having a pair of second U-shaped locking portions facing downwardly and located at two lateral sides thereof for latching with the first U-shaped locking portions so that the spacer could be retained in the insulative housing firmly in the transverse direction; and a metal shell coupled to the insulative housing for shielding the contacts; wherein the extending portions have a pair of embossments protruding inwardly from the first U-shaped locking portions, the spacer has a pair of recesses recessed inwardly from two outer faces of the second U-shaped locking portions for receiving the embossment so that the spacer could be retained in the insulative housing firmly in a front-to-rear direction perpendicular to the transverse direction.

12. The electrical connector according to claim 11, wherein the spacer is assembled to the insulative housing along a lower-to-upper direction, the spacer defines a first dimension measured between two lateral faces thereof larger than a second dimension measured between two inner faces of the extending portions, when the spacer is assembled to the insulative housing from a lower face of the insulative housing, the extending portions are flared outwardly to create an enlarged space for the spacer assembled thereto, when the spacer has been assembled to the insulative housing, the second U-shaped locking portions latch with the first U-shaped locking portions so as to keep the extending portions on their original places.

13. The electrical connector according to claim 11, wherein the extending portions have oblique faces extending in an oblique direction and located above the first U-shaped locking portions, the spacer has a pair of inclined faces formed at two lateral sides thereof and located above the second U-shaped locking portions for being resisted inwardly and downwardly by the oblique faces.

14. An electrical connector comprising:

an insulative housing defining a front mating region and rear mounting region in a front-to-back direction;

a plurality of contacts disposed in the housing, each of said contacts including a front mating section exposed in the front horizontal mating region and a rear vertical mounting section exposed in the rear mounting region and extending in a vertical direction perpendicular to said front-to-back direction;

a pair of upward grooves formed around two opposite ends of the rear mounting region in a transverse direction perpendicular to said front-to-back direction and said vertical direction; and an insulative spacer including a horizontal body with therein a plurality of through holes extending in said vertical direction, and a pair of downward locking blocks at two opposite ends of said transverse direction and received in the corresponding upward grooves, respectively; wherein said spacer is adapted to be upwardly assembled into the rear mounting region under condition that the mounting sections of the contacts received in the corresponding through holes and with the pair of blocks respectively received in the corresponding grooves; wherein a downward restriction structure is formed above each corresponding upward groove to restrain upward movement of the spacer once the block is snugly received in the corresponding groove and an embossment around the each of the grooves received in a corresponding cutout formed in the spacer to restrain said spacer from moving in the front-to-back direction.

15. The electrical connector as claimed in claim 14, wherein said pair of upward grooves are unitarily formed in the housing.

16. The electrical connector as claimed in claim 14, wherein said spacer defines a body between said pair of blocks each to cooperate with the corresponding block to sandwich therebetween a portion of the housing which is located beside the corresponding groove.

* * * * *